United States Patent [19]

Saleck et al.

[11] 4,241,173

[45] Dec. 23, 1980

[54] PROCESS FOR THE PREPARATION OF SILVER HALIDE EMULSIONS

[75] Inventors: Wilhelm Saleck, Schildgen; Harald von Rintelen, Leverkusen, both of Fed. Rep. of Germany

[73] Assignee: AGFA-Gevaert, A.G., Fed. Rep. of Germany

[21] Appl. No.: 936,377

[22] Filed: Aug. 24, 1978

Related U.S. Application Data

[63] Continuation-in-part of Ser. No. 704,057, Jul. 9, 1976, abandoned.

[30] Foreign Application Priority Data

Jul. 15, 1975 [DE] Fed. Rep. of Germany ..... 2531599
Oct. 3, 1975 [DE] Fed. Rep. of Germany ..... 2544152

[51] Int. Cl.[3] ..... G03C 1/02
[52] U.S. Cl. ..... 430/569
[58] Field of Search ..... 96/94 R, 107–108, 96/114, 114.7; 430/569

[56] References Cited

U.S. PATENT DOCUMENTS

| | | | |
|---|---|---|---|
| 3,320,069 | 5/1967 | Illingsworth | 96/107 |
| 3,482,982 | 12/1969 | Miyata | 96/94 R |

OTHER PUBLICATIONS

Duffin: Photographic Emulsion Chemistry, The Focal Press, 1969, pp. 66–67.
Baker: Photographic Emulsion Technique, 2nd Edition, American Photographic Publishing Co., 1948, pp. 119–120.

*Primary Examiner*—Won H. Louie, Jr.
*Attorney, Agent, or Firm*—Connolly & Hutz

[57] ABSTRACT

Silver halide is precipitated in a large excess of a soluble chloride that forms together with silver ions a silver salt more readily soluble than the silver salt of the final emulsion. By precipitation of silver halide in the presence of the soluble chloride used in excess part of the silver chloride is carried along with the less soluble silver halide and may subsequently be converted into the less soluble silver halide.

2 Claims, No Drawings

PROCESS FOR THE PREPARATION OF SILVER HALIDE EMULSIONS

This application is a continuation in part of the copending U.S. Application Ser. No. 704,057 filed July 9, 1976 for Process For The Preparation Of Silver Halide Emulsions, now abandoned.

This invention relates to a light-sensitive photographic silver halide emulsion and to a process for its preparation. The special feature of the silver halide emulsions according to the invention is that the silver halide is precipitated in a large excess of a soluble chloride.

Various methods for the preparation of silver halide emulsions are known and the emulsions may be distinguished according to their method of preparation, for example as pouring emulsions (rapidly precipitated emulsions), inflow and double inflow emulsions, ammonia emulsions and boiling emulsions. The sensitometric properties of the emulsions such as their sensitivity, contrast, tendency to fogging and graininess depend to a large extent on the method by which they have been prepared. Precipitation of the silver halide is generally carried out by reacting silver nitrate with a slight molar excess of up to about 30 mol% of a soluble halide to achieve controlled Ostwald ripening. Larger excesses of the soluble halide are generally avoided because otherwise the emulsions obtained are unstable and have a tendency to fogging.

The relationship between sensitivity and graininess is of major importance in modern photographic materials, particularly in colour photographic materials. For a given type of emulsion an increase in sensitivity is generally obtained at the expense of the graininess. It is an object of this invention to provide a photographic silver halide emulsion in which the graininess is improved without substantial loss in sensitivity. The invention also provides an improvement in the development kinetics with regard to utilisation of the sensitivity and completeness of development.

The invention relates to a process for the preparation of light-sensitive photographic silver halide emulsions by reaction of an aqueous solution of a silver salt with an aqueous halide solution, which reaction is carried out in the pH range of between 5.0 and 9.0 in the presence of an excess of at least ½ mol of a soluble chloride, based on one equivalent of the silver ions present in the precipitation medium, the silver chloride used in excess having a higher solubility product than the less soluble component of the silver halide which is to be precipitated.

The term "solubility product" as used throughout this specification is known to the average expert and indicates the product of concentrations of silver ions and halide ions in a saturated aqueous solution of a particular silver halide being in equilibrium with the same solid silver halide.

In practice, the process of the present invention is carried out by precipitating the silver halide, e.g. silver bromide or silver iodobromide, by reacting silver nitrate with the appropriate soluble halides in the presence of a large excess of a soluble chloride such as sodium, potassium or ammonium chloride. In any event, the silver chloride has a higher solubility product than the more sparingly soluble component of the silver halide which is to be precipitated, in other words it is more readily soluble than the latter.

Preparation of a silver halide emulsion by the process according to the invention may be carried out for example by reacting silver nitrate with approximately the equivalent amount or a small excess optionally up to 20 mol% of a first water-soluble halide or halide mixture, however in the presence of a high excess of at least 50 mol%, e.g. 1 mol per mol of silver nitrate, of a water soluble chloride. The halides used according to this embodiment of the invention are chosen such that the first and the second halides form different silver halides of different solubilities; the silver chloride which is used in excess forming the more soluble silver halide having a solubility product higher than that of the silver halide formed from the first water-soluble halide.

Preparation of a silver bromide emulsion by the process according to the invention may be carried out, for example, by reacting silver nitrate with at least the equivalent quantity of a soluble bromide in the presence of a large excess (e.g. 1 mol per mol of silver nitrate) of a soluble chloride. If desired, the total quantity of chloride may be present in the reaction vessel at the onset of precipitation, but one may equally well introduce only part of the total quantity of chloride at the onset of precipitation and add the rest either continuously or portionwise during the precipitation. In either case, care must be taken to ensure that at any moment during precipitation the soluble chloride is present in an excess of at least ½ mol per mol of the silver ions already present in the precipitation chamber.

If a mixed silver halide is required to be precipitated, for example a silver iodobromide or silver chlorobromide, precipitation of the silver halide is carried out using an aqueous halide solution containing various halides in a composition substantially corresponding to the composition of the required silver halide, but with an excess of chloride ions.

The mixed halide solution (first halide) may then be reacted with approximately equivalent quantity of a silver salt solution. If a less than equivalent quantity of mixed halide solution is used, the amount of halide necessary to make up the equivalent amount is taken from the chloride solution present in excess in the reaction vessel. The following example serves to illustrate this point:

1 Mol of chloride is introduced into a reaction vessel. 1 Mol of silver nitrate and 1 mol of halide consisting of 90 mol% of bromide and 10 mol% of iodide are provided for the reaction.

A mixed silver halide is obtained in which the molar quantities of silver bromide and silver iodide are in the ratio of 9:1 and which may contain up to 10 mol% of silver chloride, depending on the conditions under which the various components are run into the reaction vessel. The probable explanation for the silver chloride content is that when precipitation takes place, part of the chloride present in excess is carried along as silver chloride which is subsequently not completely replaced by the more sparingly soluble silver halide. An even much higher silver chloride content may result if, for example, only 0.8 mol or less of mixed halide solution is used per mol of silver nitrate.

In the process according to the present invention, however, the total quantity of the first water soluble halide forming the most sparingly soluble silver halide emulsion, may be placed into the precipitation vessel from the start or all of it or part of it may be run into the precipitation vessel from the start or all or part of it may be run into the precipitation chamber simultaneously with the solution of silver salt. The halide which is to be precipitated and the silver salt solution may be introduced simultaneously or alternately into the precipitation chamber. The addition may be carried out continuously or portionwise and if portionwise, the addition is preferably interrupted by intervals enabling a precipitation equilibrium to be established.

The process according to the invention may be employed for the preparation of silver bromide, silver iodobromide, silver chlorobromide or silver chloroidobromide emulsions. The silver halide emulsions generally contain at least 40 mol% of silver bromide and they may contain up to 60 mol% of silver chloride and up to 15 mol% but preferably between 0.5 and 10 mol% of silver iodide. For some purposes, silver halide emulsions prepared according to the invention which consist substantially of silver bromide and have a silver chloride content of between 0.5 and 10 mol% are also suitable.

Precipitation of the silver halide is advantageously carried out at elevated temperatures, for example at between 45° C. and 75° C. The most suitable protective colloid used for precipitation of the silver halide is gelatine but it may be partly or completely replaced by other natural or synthetic polymers, for example homopolymers or copolymers of acrylic or methacrylic acid derivatives such as those described in German Offenlegungsschriften No. 2,506,405 and 2,508,270. Silicic acid sols according to German OS No. 1,797,270 and German OS No. 2,159,379 are also examples of useful additives for the precipitation mixture.

When precipitation has been completed, and emulsion is flocculated in the usual manner, for example by the addition of polystyrene sulphonic acid and lowering of the pH to 3.0, and is then decanted and washed to free it from excess salts. The flocculate is redispersed in an aqueous solution by increasing the pH and the required quantity of gelatine is added. The usual ripening additives are added and the dispersion is chemically ripened to maximum sensitivity at a given temperature and at a pH of from 5.0 to 6.8 and at pAg of from 8.6 to 9.2. If required, noble metal salts such as platinum metal salts and gold salts may be added for after-ripening.

The binder used for the photographic layers is preferably gelatine but this may be partly or completely replaced by other natural or synthetic binders. Suitable natural binders include e.g. alginic acid and its derivatives such as its salts, esters or amides, cellulose derivatives such as carboxymethylcellulose, alkyl celluloses such as hydroxyethylcellulose, starch or its derivatives such as ethers or esters or carrageenates. Polyvinyl alcohol, partially saponified polyvinyl acetone, and polyvinyl pyrrolidone are examples of suitable synthetic binders.

The emulsions may also be chemically sensitized, for example sulphur compounds such as allyl isothiocyanate, allyl thiourea, and sodium thiosulphate may be added at the stage of chemical ripening. Reducing agents may also be used as chemical sensitizers, for example, the tin compounds described in Belgian Patent Specifications No. 493,464 and 568,687 or polyamines such as diethylene triamine or aminomethane sulphinic acid derivatives, e.g. according to Belgian Patent Specification No. 547,323.

Noble metals such as gold, platinum, palladium, iridium, ruthenium or rhodium and compounds of these metals are also suitable chemical sensitizers. This method of chemical sensitization has been described in the article by R. Koslowsky, Z.Wiss.Phot. 46, 45 to 72 (1951).

The emulsions may also be sensitized with polyalkylene oxide derivatives, e.g. with a polyethylene oxide having a molecular weight of between 1000 and 20,000 or with condensation products of alkylene oxides, e.g. with aliphatic alcohols, glycols or cyclic dehydration products of hexitols, with alkyl substituted phenols, aliphatic carboxylic acids, aliphatic amines or aliphatic diamines and amides as well as with phosphoric acid esters. The condensation products should have a molecular weight of at least 700 and preferably more than 1000. These sensitizers may, of course, be combined to achieve special effects as described in Belgian Patent Specification No. 537,278 and in British Patent Specification No. 727,982. Ripening accelerators are also particularly suitable for after-ripening, for example those described in German Offenlegungsschrift No. 1,472,792.

The emulsions may also be spectrally sensitized, for example by the usual monomethine or polymethine dyes such as acid or basic cyanines, hemicyanines, streptocyanines, merocyanines, oxonoles, hemioxonoles, and styryl dyes, as well as trinuclear or multinuclear methine dyes for example rhodacyanines or neocyanines. Sensitizers of this kind have been described, for example, in the work by F. M. Hamer entitled "The Cyanine Dyes and Related Compounds" (1964), Interscience Publishers John Wiley and Sons.

The emulsions may contain the usual stabilizers, e.g. homopolar or salt type compounds of mercury containing aromatic or heterocyclic rings, such as mercapto triazoles, simple mercury salts, sulphonium mercury double salts and other mercury compounds. Azaindenes are also suitable stabilizers, particularly tetra- or pentaazaindenes and especially those which are substituted with hydroxyl or amino groups. Compounds of this kind have been described in the article by Birr, Z.Wiss.Phot. 47, 2 to 27 (1952). Other suitable stabilizers include heterocyclic mercapto compounds, e.g. phenyl mercaptotetrazole, quaternary benzothiazole derivatives and benzotriazole. Particularly suitable stabilizers have been described inter alia in German Offenlegungsschrift No. 1,597,503.

Derivatives of hydroquinone and of pyrocatechol as well as the cyclic thiouronium compounds of German Patent No. 1,209,425 may advantageously be used as casting additives for the emulsion layers to improve fogging, particularly for colour photographic layers.

The emulsions may be hardened in the usual manner, for example by means of formaldehyde or halogenated aldehydes which contain a carboxyl group such as mucobromic acid, diketones, methane sulphonic acid esters, and dialdehydes.

The photographic emulsions may also be hardened with epoxide hardeners, heterocyclic ethylene imine or acryloyl hardeners. Examples of such hardeners have been described, for example, in German Offenlegungsschrift No. 2,263,602 and in British Patent Specification No. 1,266,655. The layers may also be hardened by the process described in German Offenlegungsschrift No. 2,218,009 to produce colour photographic materials which are suitable for high temperature processing.

The photographic layers or colour photographic multilayered materials may also be hardened with hardeners of the diazine, triazine, or 1,2-dihydroquinoline series as described in British Patent Specifications No. 1,193,290; 1,251,091; 1,306,544 and 1,266,655; French Specification No. 7,102,716 and German Offenlegungsschrift No. 2,332,317. Examples of such hardeners include diazine derivatives which have alkylsulphonyl or arylsulphonyl groups, derivatives of hydrogenated diazines or triazines such as 1,3,5-hexahydrotriazine, fluorosubstituted diazine derivatives such as fluoropyrimidines, or esters of 2-substituted 1,2-dihydroquinoline- or 1,2-dihydroisoquinoline-N-carboxylic acids. Vinyl sulphonic acid hardeners and carbodiimide or carbamoyl hardeners are also suitable, for example those described in German Offenlegungsschrift No. 2,263,602; 2,225,230 and 1,800,685; French Patent Specification No. 1,491,807; German Patent Specification No. 872,153 and DDR Patent Specification No. 7218. Other suitable hardeners have been described, for example, in British Patent Specification No. 1,268,550.

The invention will now be explained with the aid of the following Examples.

EXPERIMENT 1(COMPARISON)

A silver iodobromide emulsion containing 5 mol% of AgI as described in the publication by Trivelli and Smith in "The Photographic Journal", Volume 79, May 1939, pages 330 to 338 was prepared as comparison emulsion. One third of the silver nitrate solution was added to a soluble halide mixture which was in 10% excess of halide as compared with the total amount of silver added as silver nitrate within 1 minute at 70° C. and after an interval of 10 minutes, the remainder was added over a period of 20 minutes. When precipitation had been completed, the emulsion was flocculated by adding polystyrene sulphonic acid and lowering the pH to 3.0 with mineral acid and it was then decanted and washed to dissolve out excess water-soluble salts. It was then redispersed at pH 7.0 and the necessary quantity of gelatine as well as sodium thiosulphate and gold chloride were added and the dispersion was ripened to maximum sensitivity at a temperature of between 50° C. and 60° C. and a pH of 6.0 and pAg of 8.6 to 9.2.

EXPERIMENT 2 (ACCORDING TO THE INVENTION)

In a second experiment, an emulsion according to the invention was prepared by adding to the halide solution in the reaction vessel containing 5 mol% of iodide 1 mol of sodium chloride, based on 1 mol of silver nitrate to be used. After precipitation of the silver halide, which was done as described in Experiment 1 by the addition of silver nitrate, the process was continued in the usual manner as described above.

EXPERIMENT 3 (ACCORDING TO THE INVENTION)

In a third experiment using the same starting materials and procedure as in the second experiment, the second period of inflow of the silver nitrate was reduced by 25% to 15 minutes and the interval between the first period of inflow and the second was reduced by 50% to 5 minutes. The procedure was otherwise the same. A portion of each of the three emulsion was made ready for casting by adding per kg 20 ml of a 1% methanolic solution of 4-hydroxy-6-methyl-1,3,3a,7-tetraazaindene, 10 ml of a 10% aqueous formalin solution and 10 ml of a 5% aqueous solution of saponin as wetting agent. The emulsions were cast on a cellulose acetate substrate and the samples were exposed behind a grey wedge and developed for 7 minutes in a developer of the following composition:

| | |
|---|---|
| Sodium sulphite sicc. | 70.0 g |
| Borax | 7.0 g |
| Hydroquinone | 3.5 g |
| p-Monomethylaminophenol sulphate | 3.5 g |
| Sodium citrate | 7.0 g |
| Potassium bromide | 0.4 g |
| made up to 1 liter with water | |

TABLE 1

| Experiment | Silver appln. g of $AgNO_3/m^2$ | Relative sensitivity (°DIN) | $\gamma$ | Fog | $D_{max}$ | Average grain size diameter in micron | % reduction |
|---|---|---|---|---|---|---|---|
| 1 Comparison | 7.2 | standard | 0.60 | 0.18 | 1.85 | 0.67 | |
| 2 | 7.1 | ±0 | 0.70 | 0.18 | 2.60 | 0.53 | 21% |
| 3 | 7.2 | −0.5° | 0.80 | 0.20 | 2.90 | 0.39 | 42% |
| | | 3° = 1 shutter speed | | | | | |

The results of the photographic examination are shown in Table 1. When compared with the conventional emulsion (Experiment 1) which had an average crystal size of 0.67 micron, the emulsion according to the invention obtained in Experiment 2 was found to have the same sensitivity but an average crystal size of 0.53 micron while the emulsion obtained in Experiment 3 had a sensitivity of only 0.5° less but an average crystal size of 0.39 micron. The maximum density of the emulsions according to the invention and hence the capacity of the emulsions for complete development was much higher than that of the comparison emulsion for a comparable application of silver.

Individual colour films were cast to prove that this effect is also applicable to colour photographic layers. Another portion of each of the comparison emulsions (1), (2) and (3) described above was made ready for casting by placing into a reaction vessel 8 ml of a 1% methanolic 4-hydroxy-6-methyl-1,3,3a, 7-tetraazindene solution for every 60 g of emulsion and melting the emulsion in this solution at 40° C. A sufficient quantity of an 8% gelatine solution was then added to obtain the required silver application. The following substances were then added in the sequence given: 0.2 ml of glycerol/water (1:1).

14 ml of panchromatic sensitizer (Formula A see below) dissolved 1:1000 in aqueous methanol and stirred for 45 minutes at 40° C., 2.5 g of cyan-forming coupler (formula B, see below) as emulsion component in tricresyl phosphate and gelatine (1:1:1), 0.1 g of chromalum as hardener.

All three experimental emulsions were cast on a cellulose acetate substrate covered with an antihalation layer 1 $\mu$ in thickness. The silver halide emulsion layer was then covered with a protective layer 5 to 8$\mu$ in thickness obtained from a casting solution of the following composition:

200 ml of gelatine solution (3%)
5 ml of wetting agent (Formula C, see below)
1 ml of chrome alum.

To achieve rapid hardening, all three cast films were passed through a solution containing 200 ml of gelatine solution (1%)
8 ml of wetting agent (Formula C)
2 g of hardener (Formula D, see below).

After drying, the strips of film were exposed behind a grey wedge and red filter and colour developed for 3¼ minutes at 38° C. The colour developer contained 5 g of 2-amino-5-(N-ethyl-N-hydroxyethylamino)-toluene per liter as developer substance.

The results are shown in Table 2.

TABLE 2

| Experiment | Silver application g of $AgNO_3/m^2$ | 3¼ minutes development at 38° C. Relative sensitivity (°DIN) | γ | Fog | $D_{max}$ |
|---|---|---|---|---|---|
| 1 (comparison) | 2.6 g | standard | 1.1 | 0.22 | 2.3 |
| 2 | 2.7 g | +1° | 1.3 | 0.22 | 3.1 |
| 3 | 2.0 g | +1.5° | 1.3 | 0.23 | 3.2 |

3° DIN = 1 shutter stop

Whereas the emulsion according to the invention were equally sensitive (Experiment 2) or less sensitive by 0.5° DIN (Experiment 3) than the comparison emulsion in black-and-white development (Table 1), in colour development, the emulsion obtained in Experiment 3 was more sensitive by 1.5° DIN and even the emulsion obtained in Experiment 2 was more sensitive by 1°DIN than the comparison emulsion (1). This shows that utilisation of the potential sensitivity for development is improved in high temperature colour development. The grain of the colour is also finer in correspondence with the smaller average grain diameter and is finest in experimental emulsion (3) as can be seen when the films are viewed behind a red filter in a comparison microscope with a magnification of 100.

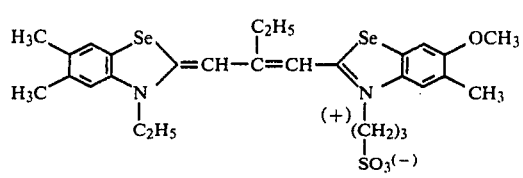
(A)

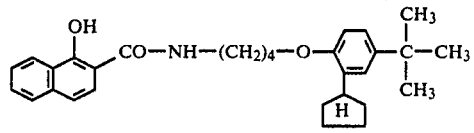
(B)

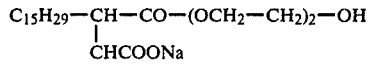
(C)

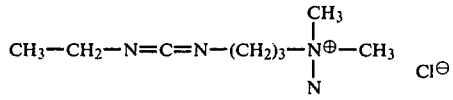
(D)

What is claimed is:

1. The process for producing a fine-grain without loss of sensitivity in the preparation of light sensitive silver halide emulsions of which the silver halide contains at least 40 mol% of silver bromide and from 0 to 15 mol% of silver iodide and from 0 to 60 mol% of silver chloride by reacting a soluble silver salt with at least the equivalent amount of an aqueous halide solution and precipitating the silver halide in the pH range of between 5.0 and 9.0, wherein the improvement comprises producing at least 20% reduction in grain size of said silver halide without a loss of sensitivity and preventing a loss of sensitivity in said emulsion by carrying on the precipitation of said silver halide in the presence of an excess of at least 1 mol of a water soluble chloride based on 1 equivalent of silver ions present in the precipitation medium, said soluble chloride being selected from the group consisting of sodium chloride, potassium chloride, and ammonium chloride.

2. The process as claimed in claim 1, in which all of the bromide or mixed halide to be precipitated together with the soluble chloride used in excess is placed into the precipitation vessel from the start.

* * * * *